US007320436B2

(12) United States Patent
Runeman et al.

(10) Patent No.: US 7,320,436 B2
(45) Date of Patent: Jan. 22, 2008

(54) METHOD OF PRODUCING AN ABSORBENT ARTICLE AND AN ABSORBENT ARTICLE PRODUCED ACCORDING TO THE METHOD

(75) Inventors: Bo Runeman, Partille (SE); Anne Farbrot, Askim (SE); Madeleine Hjorth, Göteborg (SE); Ralph Dovertie, Västra Frölunda (SE)

(73) Assignee: SCA Hygiene Products AB, Gothenburg (SE)

( * ) Notice: Subject to any disclaimer, the term of this patent is extended or adjusted under 35 U.S.C. 154(b) by 391 days.

(21) Appl. No.: 10/787,939

(22) Filed: Feb. 27, 2004

(65) Prior Publication Data

US 2004/0227008 A1 Nov. 18, 2004

Related U.S. Application Data

(60) Provisional application No. 60/450,356, filed on Feb. 28, 2003.

(51) Int. Cl.
*A62C 5/02* (2006.01)

(52) U.S. Cl. ..... 239/8; 239/290; 239/296; 239/298; 427/427.6; 427/427.4

(58) Field of Classification Search ..... 239/104, 239/105, 128, 133, 135, 270, 290, 296, 298; 222/146.2, 146.5, 504; 156/164, 167; 427/421.1, 427/427.4, 427.6
See application file for complete search history.

(56) References Cited

U.S. PATENT DOCUMENTS

| | | | | |
|---|---|---|---|---|
| 3,896,807 A | | 7/1975 | Buchalter | |
| 4,764,242 A | * | 8/1988 | Gressick et al. | 156/494 |
| 4,785,996 A | | 11/1988 | Ziecker et al. | |
| RE33,481 E | * | 12/1990 | Ziecker et al. | 239/298 |
| 5,208,064 A | * | 5/1993 | Becker et al. | 427/8 |
| 5,643,588 A | | 7/1997 | Roe et al. | |
| 5,725,714 A | * | 3/1998 | Fujioka et al. | 156/259 |
| 6,149,934 A | * | 11/2000 | Krzysik et al. | 424/443 |
| 6,217,890 B1 | * | 4/2001 | Paul et al. | 424/402 |
| RE37,154 E | * | 5/2001 | Nomura et al. | 156/164 |
| 6,311,899 B1 | * | 11/2001 | Hidaka et al. | 239/298 |

FOREIGN PATENT DOCUMENTS

| | | |
|---|---|---|
| EP | 1 250 940 A1 | 10/2002 |
| WO | WO 96/16681 | 6/1996 |
| WO | WO 96/16682 | 6/1996 |
| WO | WO 98/24390 | 6/1998 |
| WO | WO 99/45974 | 9/1999 |
| WO | WO 00/48544 | 8/2000 |
| WO | WO 00/69484 | 11/2000 |

* cited by examiner

*Primary Examiner*—Dinh Q. Nguyen
(74) *Attorney, Agent, or Firm*—Buchanan Ingersoll & Rooney, PC

(57) ABSTRACT

A method for applying lotion to a surface of an absorbent article. The method includes the steps of: placing the surface of the absorbent article in the proximity of a spraying apparatus having a spray head with an orifice; pushing the lotion through the spray head orifice; and propelling the lotion to the surface as a continuous fiberised string. The invention also pertains to an absorbent article having a surface with an application of lotion.

15 Claims, 7 Drawing Sheets

METHOD OF PRODUCING AN ABSORBENT ARTICLE AND AN ABSORBENT ARTICLE PRODUCED ACCORDING TO THE METHOD

This application claims priority under 35 U.S.C. § 119 to U.S. Provisional Application No. 60/450,356 entitled "Method of Producing An Absorbent Article and an Absorbent Article Produced According to the Method" and filed on Feb. 28, 2003, the entire content of which is hereby incorporated by reference.

TECHNICAL FIELD

The present invention relates to a method for applying a lotion to a surface of an absorbent article, and in particular, a method comprising the steps of: placing the surface of the absorbent article in the proximity of a spraying apparatus comprising a spray head having an orifice and pushing the lotion through the spray head orifice.

BACKGROUND ART

Absorbent articles having lotion applied on, for example, the topsheet have been known within the area for quite some time now. By applying lotion on an absorbent article such as a diaper, an incontinence product, a sanitary napkin or the like, added value is given to the product.

As described in WO 96/16682, the lotion, or similar product, could be placed on the topsheet of a diaper. In this manner, the lotion is said to add barrier properties to the skin, reducing the irritation caused by contact with faeces.

Further back in time, similar use of lotions was known, for example, through U.S. Pat. No. 3,896,807, which describes how the surface of a diaper can be furnished with an emulsifiable phase which upon exposure to moisture will form a water/oil (W/O) or oil/water (O/W) emulsion. During use of the product, the emulsion will transfer to the user's skin and will act as a vehicle for adding skin caring substances to the user's skin.

In earlier published literature, several examples are given of how to apply the lotion on absorbent articles.

In WO 96/16681 spraying, printing (e.g. flexographic printing), coating and extrusion are mentioned as examples of application methods. With the spray technique, it is said to be possible to spray patterns having a dimension of 9×18 cm.

In WO 98/24390 and WO 99/45974, slot coating, extrusion coating, gravure coating, spraying and printing are mentioned. The lotion can be applied in stripes, squares, dots or spirals.

WO 00/48544 more thoroughly describes the techniques used to apply lotion on absorbent articles. More specifically, spraying is described. When spraying, the lotion is propelled through a nozzle by means of air. However, it can also be propelled through the nozzle substantially without the use of air. Further, it is described that the nozzle can be mechanically manipulated during spraying to form patterns such as spirals, squares, stripes or circles. In order to achieve a desired pattern such as a square, the nozzle itself needs to be altered. It is also stated that the stripes have a minimum with of 0.1 inches.

The existing spray technique offers some advantages to the producer of absorbent articles wanting to give added values to absorbent articles. However, several disadvantages still exist that the prior art has failed to remove.

When the lotion is sprayed through the orifice of the nozzle at high speed, it is subjected to a high amount of stress. The stress is not only purely mechanical stress, but is also caused by pressure differences. This causes the lotion to turn into an aerosol fully, or partly, which greatly affects the quality of the applied pattern and the flexibility of the process.

Even if it is possible to make patterns such as spirals, stripes or circles, the applied pattern becomes diffuse in the periphery and the aerosolised spray string makes it difficult to add lotion in an exact manner.

The nozzle of the spray head needs to be in close proximity to the sprayed surface. This prevents the spray string from being spread too much in an uncontrolled manner. However, this is a severe limitation to process flexibility since even if the slightest amount of aerosol is formed, it will complicate the handling and the flexibility of the process.

The fine droplets from the aerosol which lie in the periphery of the sprayed string can easily be sucked down into the absorbent core by the capillary forces of the absorbent core or an acquisition layer. This reduces the absorbent capacity and the acquisition rate of the absorbent article. Accordingly, it is important to keep the lotion on the surface of the absorbent article.

From a process point of view, it is difficult to handle aerosols when manufacturing absorbent articles. Reducing the amount of aerosol vastly reduces the required amount of cleaning and maintenance of the production equipment.

Consequently, there is a need for a method of applying lotion to absorbent articles in a simple and efficient manner. Hence, it is an object of the current invention to solve the above-mentioned problems and to provide an improved method for applying lotion to absorbent articles. It is also an object of the invention to provide an absorbent article having lotion arranged in a well-defined application pattern.

SUMMARY OF THE INVENTION

The current invention provides a method of applying lotion to an absorbent article. The method of the invention is distinguished in that the lotion is sprayed as a continuous fiberised string.

The term "fiberised string" means that the lotion is in the form of a continuous string and that no amount of aerosol is formed. In contrast to ordinary lotion which is sprayed in a continuous pattern, the lotion sprayed as a fiberised string forms no aerosol or droplets when leaving the spray head orifice. The lotion can be laid in an intermittent pattern or in a continuous pattern. However, the string in itself is still continuous. In addition, the fiberised string is relatively thin as compared to ordinary sprayed strings.

More specifically, the invention concerns a method for applying a lotion to a surface of an absorbent article, said method comprising the steps of: placing the surface of the absorbent article in the proximity of a spraying apparatus comprising a spray head having an orifice; pushing the lotion through the spray head orifice and propelling the lotion to the surface as a continuous fiberised string.

The term "proximity" should not be taken to mean that the spraying apparatus needs to be in direct contact or even close to the surface of the absorbent article. In accordance with the invention, the spray head and the spraying apparatus can be separated by several meters of hose, pipe or the like. The term proximity should be interpreted as indicating a correlating relationship between the surface of the absorbent article, the spray head and the spraying apparatus.

By propelling the lotion as a continuous fiberised string instead of spraying in stripes or ordinary lines, several advantages are obtained. Due to the use of a fiberised string, the spray head can be placed within a wide variety of distances from the surface of the absorbent article. In one embodiment of the invention the surface is placed at a distance of 15-300 mm from the spray head.

Several different kinds of spray heads can be used. In one embodiment of the invention the lotion is propelled from the orifice by an air stream that is separated from the orifice. In another embodiment of the invention the lotion is sprayed with a velocity of at least 80 m/min.

In a preferred embodiment of the invention the lotion is propelled to the surface of the absorbent article as a spiral continuous fiberised string.

The invention makes it possible to spray very thin fiberised strings of lotion. This saves lotion as well as prohibits blocking of, for example, the topsheet of the absorbent article. In one embodiment of the invention, the fiberised string has a diameter of less than 2.2 mm, preferably less than 1 mm and most preferably less than 0.75 mm.

Surprisingly, the inventor has found that by using spray equipment normally used for spraying hot-melt adhesive and a lotion with an elastic behaviour measured by storage modulus G'>0.2 Pa measured at 55° C., preferably a storage modulus G'>0.6 Pa measured at 55° C., remarkable results are achieved.

Using lotion with a storage modulus G'>0.2 Pa measured at 55° C. combined with this technique offers the possibility of processing the lotion at high temperatures without lotion disruption or the formation of lotion aerosols or droplets. This prohibits the lotion from forming lumps due to processing in temperatures close to the lotion melting point. Such lumps could otherwise cause blockage of tubes or nozzles.

The technique also makes it possible to obtain a cleaner environment around the process. By eliminating the formation of aerosols due to lotion disruption, less cleaning and less maintenance is required.

The spray technique in accordance with the invention and, in particular when preferably used with the specified lotion parameters, makes it possible to offer a more flexible production than with earlier spray techniques or techniques such as slot-coating. Moreover, the invention makes it possible to spray from a longer distance than before and to apply more exact patterns on the surface of the absorbent article. As an example, it is now possible to spray the lotion in three-dimensional-like patterns, stacking several strings on each other and forming a web-like lotion pattern.

Due to its elastic behaviour, the lotion is prevented from being sucked into the absorption core by capillary action. Instead, the lotion stays on the topsheet of the absorbent article.

In one embodiment of the invention, a spray head is used to apply lotion on an absorbent article, the spray head comprising an orifice where said lotion passes during use. Several air stream outlets are placed around and separated from the orifice so that, during use, air streams propel the lotion in a continuous fiberised string away from the orifice and the spray head.

The spray head is used in combination with a spraying apparatus, to apply lotion on an absorbent article.

The lotion is pushed through the orifice of the spray head and the nozzle and then propelled by separated air streams against the surface of the absorbent article. The air streams are arranged symmetrically around the orifice of the nozzle. The air streams are separated from the orifice, which means that the lotion and the air do not leave the nozzle from the same orifice.

The lotion can be applied to the topsheet of the absorbent article, to cuffs or to any other surface or surfaces of the absorbent article.

In accordance with the invention, it is also possible to form very thin fiberised strings. The fiberised strings can have a diameter of less than 2.2 mm, preferably of less than 1 mm, and most preferably of less than 0.75 mm. When compared to conventional application patterns with strips of a width dimension on the order of 2.5-5 mm, the small fiberised strings give the opportunity to add lotion to the topsheet of the absorbent article without risking blocking the topsheet. An application pattern coating a large percentage of the topsheet area will reduce the acquisition rate of the absorbent article and indirectly the absorption capacity.

The invention also relates to an absorbent article manufactured according to said method and comprising a substantially liquid impermeable backsheet, a substantially liquid permeable topsheet and an absorbent core placed between the backsheet and the topsheet. The absorbent article further comprises lotion. The lotion is in the shape of a continuous fiberised string and exhibits a storage modulus of at least 0.2 Pa measured at 55° C.

In another embodiment of the invention, the lotion exhibits a storage modulus of at least 0.6 Pa measured at 55° C. In yet another embodiment of the invention the lotion exhibits a loss modulus of at least 2.0 Pa measured at 55° C.

It is well within the scope of the invention to use different kinds of lotion. However, it is preferable that the storage modulus is at least 0.2 Pa measured at 55° C.

The lotion composition used in the invention preferably includes:

5 to 50% by weight of a component melting in the range from 25° C. to 37° C., chosen from the group of paraffins, fatty acid esters, polyhydroxy fatty acid esters, fatty alcohols, alkoxylated fatty acid esters, alkoxylated fatty alcohols and mixtures of these compounds; and 5 to 50% by weight of a component melting in the range from 40° C. to 60° C., chosen from the group of polyhydroxy fatty acid esters, $C_{14}$-$C_{22}$-fatty alcohols, $C_{12}$-$C_{22}$-fatty acids, the alkoxylated derivatives of the fatty alcohols and fatty esters, and mixtures of these components; and 25% to 45% by weight of water.

In another embodiment of the invention, the lotion is placed on the topsheet of the absorbent article as a continuous fiberised string.

BRIEF DESCRIPTION OF THE DRAWINGS

The invention will be described in greater detail below with reference to the figures shown in the accompanying drawings, in which.

DETAILED DESCRIPTION OF THE PREFERRED EMBODIMENTS

The invention can be applied to several different kinds of absorbent articles such as pant diapers, diapers, incontinence devices, sanitary napkins, pantiliners, micro-sanitary napkins, and the like.

Figure 1A:
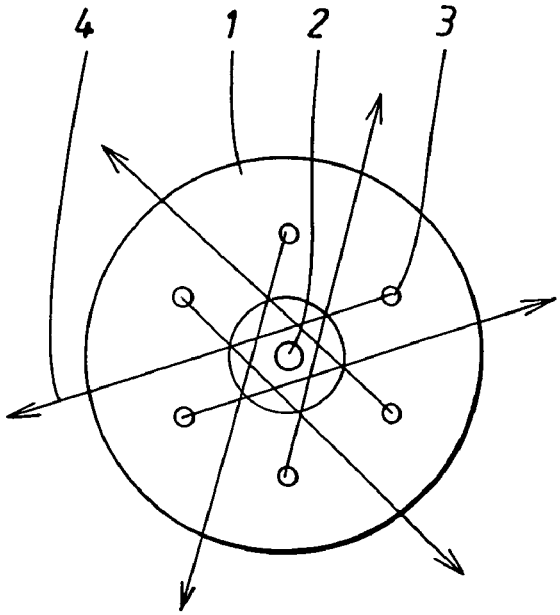
FIGS. 1*a* and 1*b* show a spray head.
Figure 1B:
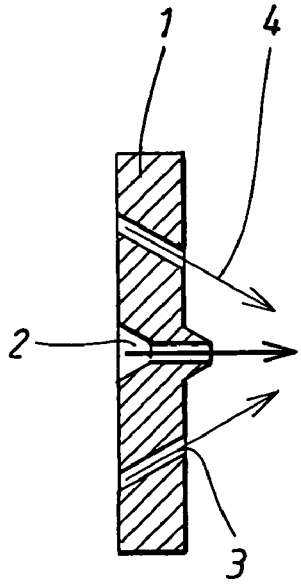

FIGS. 1*a* and 1*b* show a spray head 1 for the application of lotion to an absorbent article. The spray head 1 has a circular cross-section and is provided with an orifice 2, which also has a circular cross-section. The orifice 2 is centrally placed on the spray head 1. Separate air stream orifices 3 are preferably symmetrically placed around the central orifice 2, and are arranged to pass streams of air 4 in specified directions during use of the spray head.

The directed air streams 4 propel lotion towards the surface of an absorbent article, forming a fiberised string of lotion 5 in the shape of a helix. The fiberised string of lotion does not penetrate the topsheet and is prevented from decreasing the absorption capacity of the absorbent article.

Figure 2:
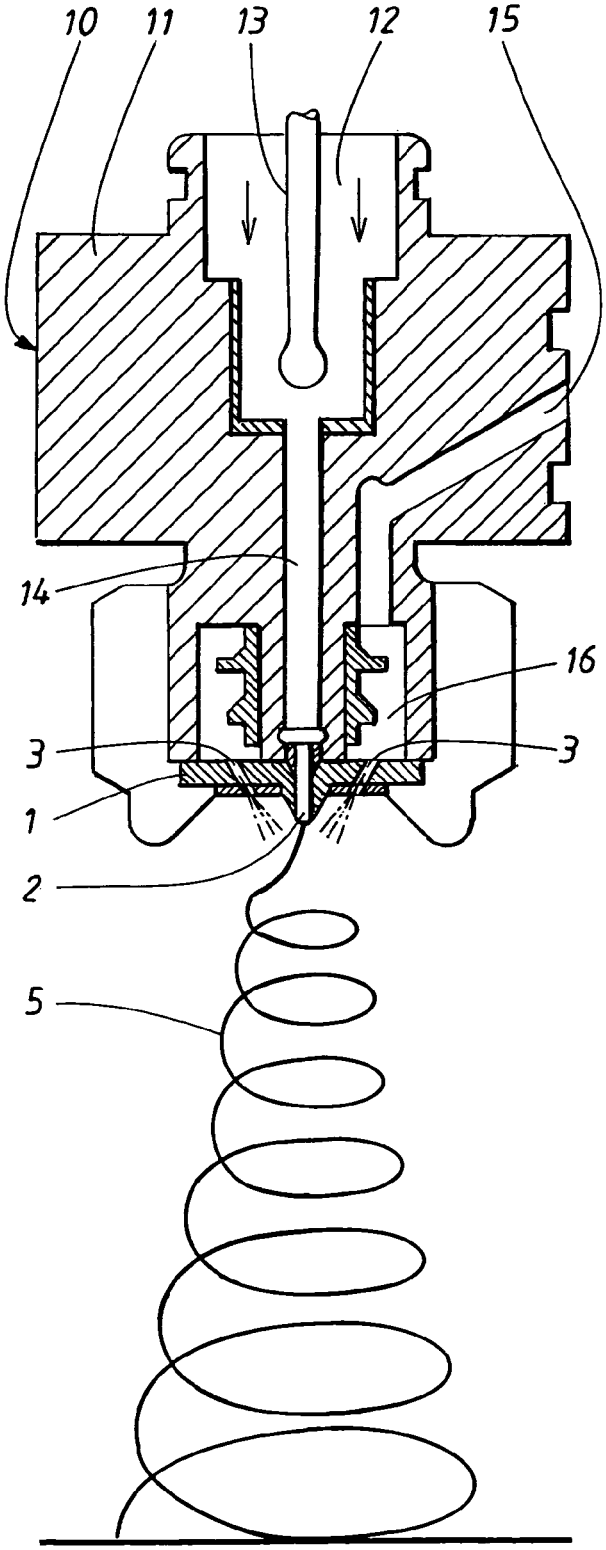
FIG. 2 shows a spray gun comprising a spray head.

FIG. 2 shows a schematic representation of the spray head 1 mounted in a part of a spray gun 10. The spray gun 10 comprises a cover 11 which comprises a temporary container 12 for the lotion. In the container 12 there is a temperature regulator 13 with which the temperature of the lotion can be regulated. From the temporary container 12, a small pipe 14 connects the central orifice 2 with the temporary container 12 on the spray head 1.

An air channel 15 supplies air to a chamber 16 arranged within the cover 11, the chamber 16 being in direct connection with the air stream orifices 3 on the spray head 1. The chamber 16 is provided with an air stream regulator by which it is possible to regulate the flow of the air streams.

Figure 2A:
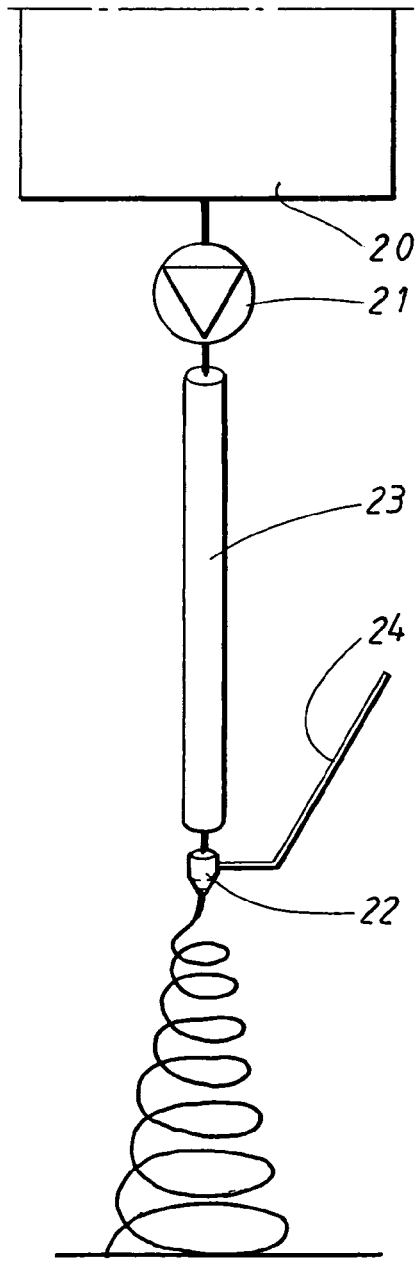
FIG. 2*a*, shows a spray apparatus.

FIG. 2*a* shows a schematic representation of a spraying apparatus such as is used in the invention. The apparatus comprises a lotion storage container 20 and a pump 21 for pumping the lotion from the storage container 20 to a spray head 22, the spray head 22 and the storage pump 21 being connected by a heated hose 23. Pressurized air 24 is supplied to the spray head 22.

Figure 3:
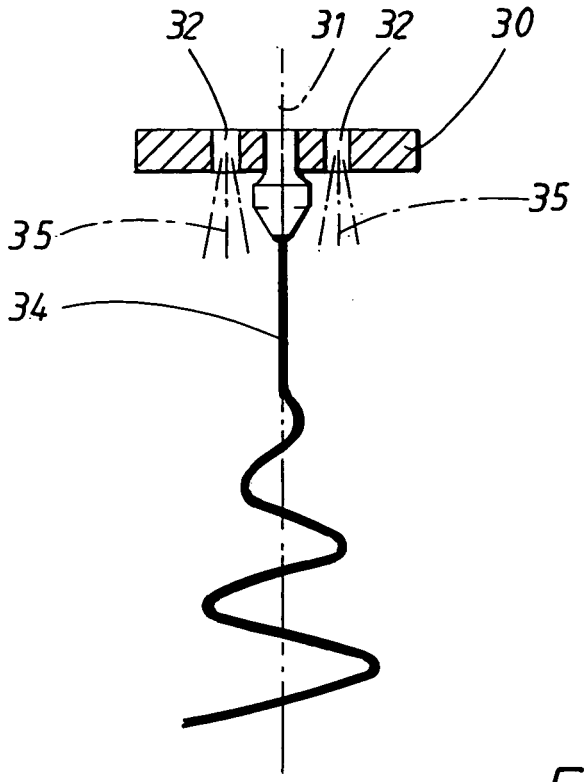
FIG. 3 shows a cross-section of a nozzle when lotion is pushed through the orifice.

FIG. 3 shows a cross-section of a nozzle 30. The nozzle 30 has a centrally placed orifice 31 and two separated air stream orifices 32, placed close to the central orifice 31 on either side thereof. FIG. 3 also shows how lotion is pushed through the central orifice 31 and is propelled by air streams 35 as it leaves the central orifice 31.

Figure 4:
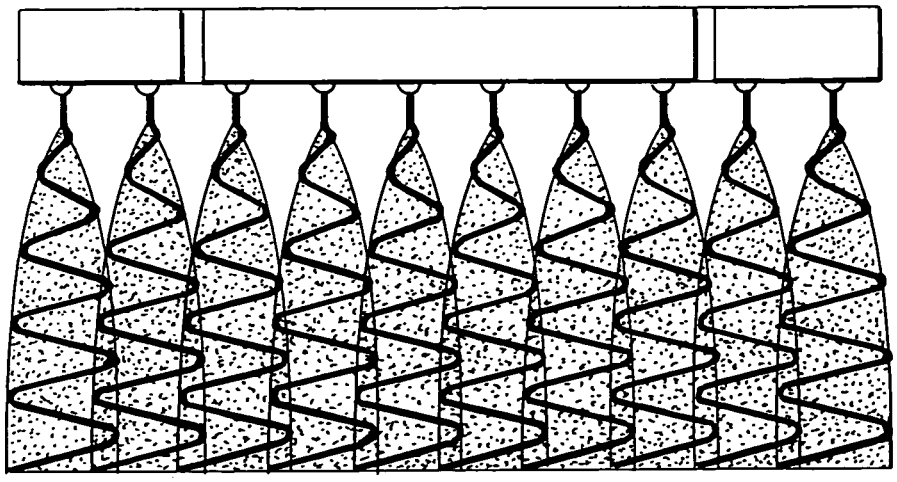
FIG. 4 shows several spray guns/modules attached in a side-by-side relationship.

FIG. 4 shows how several spray guns or modules are placed next to each other in order to produce a broader pattern of lotion on the sprayed surface. Spray heads of this type are commercially available for hot-melt adhesive applications under the trade name Controlled Fiberization Spray Nozzles, manufactured by Nordson® Corporation, 2905 Pacific Drive, Norcross, Ga. 30071, United States.

Additional models are also available from Nordson®. The spraying technique is described further in U.S. Pat. Nos. 4,785,996 and 4,815,660 and in EP Patent No. 474,155.

The Lotion Composition:

The lotion preferably is a composition comprising at least a) 5% to 50% by weight of a component melting in the range from 25° C. to 37° C., chosen from the group of paraffins, fatty acid esters, polyhydroxy fatty acid esters, fatty alcohols, alkoxylated fatty acid esters, alkoxylated fatty alcohols and mixtures of these compounds, and b) 5% to 50% by weight of a component melting in the range from 40° C. to 60° C., chosen from the group of polyhydroxy fatty acid esters, $C_{14}$-$C_{22}$-fatty alcohols, $C_{12}$-$C_{22}$-fatty acids, the alkoxylated derivatives of the fatty alcohols and fatty esters, and mixtures of these components, and c) 25% to 45% by weight of water.

The compositions according to the present invention are preferably emulsions or suspensions. The emulsions are preferably of the O/W or W/O type.

By choosing the composition so that the storage modulus exceeds 0.2 Pa, a continuous fiberised string can be achieved when spraying the lotion.

In addition to specific emulsifiers and selected oily substances, the emulsions comprise 25-45% by weight, preferably 25-40% by weight and in particular 25-35% by weight, of water. The compositions according to the invention are preferably in the form of W/O emulsions.

Component a) can be chosen from a large number of compounds known to the person skilled in the art, the melting point should be in the range from 25° C. to at most 37° C. Firstly, for this purpose it is possible to use certain paraffins, but also fatty acid esters and, in particular, fatty alcohols. Suitable paraffins are preferably semisolid paraffins, such as soft paraffin, preferably petrolatum. Suitable fatty alcohols are, for example, dodecanol or ricinol alcohol, to name one representative of the unsaturated fatty alcohols. The use of glycerides is particularly suitable, here preferably mixtures of partial glycerides and triglycerides, which should have the desired melting point of from 25° C. to 37° C. Particular preference is given here to mixtures of glycerides of fatty acids having 8 to 18 carbon atoms.

Glycerides represent mono-, di- and/or triesters of glycerol with fatty acids, namely, for example, caproic acid, caprylic acid, 2ethylhexanoic acid, capric acid, lauric acid, isotridecanoic acid, myristic acid, palmitic acid, palmoleic acid, stearic acid, isostearic acid, oleic acid, elaidic acid, petroselic acid, linoleic acid, linolenic acid, elaeostearic acid, arachidic acid, gadoleic acid, behenic acid and erucic acid, and technical-grade mixtures thereof. They conform to the formula (I),

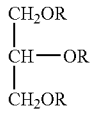

(I)

in which R is a COR' radical, in which R' is a branched or unbranched, saturated or unsaturated alkyl radical having 6 to 22 carbon atoms, and/or independently thereof, is hydrogen. Typical examples are lauric acid monoglyceride, lauric acid diglyceride, coconut fatty acid monoglyceride, coconut fatty acid triglyceride, palmitic acid monoglyceride, palmitic acid triglyceride, stearic acid monoglyceride, stearic acid diglyceride, isostearic acid monoglyceride, isostearic acid diglyceride, oleic acid monoglyceride, oleic acid diglyceride, tallow fatty acid monoglyceride, tallow fatty acid diglyceride, behenic acid monoglyceride, behenic acid diglyceride, erucic acid monoglyceride, erucic acid diglyceride, and technical-grade mixtures thereof, which may also comprise small amounts of triglyceride as secondary components from the preparation process.

Another important feature of the lotion is the emulsifier component b). Particularly suitable are glycerol partial esters with $C_{12}$-$C_{22}$-fatty acids, preferably glycerol monolaurate. Further, polyvinyl stearol ether and, particularly preferably, polyglycerol poly-12-hydroxystearate can be used.

Polyol poly-12-hydroxystearates are known substances which are sold, for example, under the names Dehymuls, PWPH or Eumulgin VL75 or Dehymuls SP11 by Cognis Deutschland GmbH. Further details regarding these compounds are given in European Patent Specification EP 0 766 661.

The polyol component of these compounds can be derived from substances which have at least 2, preferably 3 to 12 and in particular 3 to 8, hydroxyl groups and 2 to 12 carbon atoms. Typical examples are glycerol, polyglycerol, alkylene glycols, such as, for example, ethylene glycol, diethylene glycol and propylene glycol, methylol compounds, preferably trimethylolethane, trimethylolpropane, trimethylolbutane, pentaerythritol or dipentaerythritol, alkyl oligoglycosides having 1 to 22, preferably 1 to 8 and in particular 1 to 4, carbon atoms in the alkyl radical, sugar alcohols having 5 to 12 carbon atoms, for example sorbitol or manitol, and sugars having 5 to 12 carbon atoms, preferably glycose or sucrose, and also amino sugars, for example glucamine. The reaction product of poly-12-hydroxystearic acid with polyglycerol has proven particularly advantageous. Here, a preferred polyglycerol has the following composition: glycerols 5 to 35% by weight, diglycerols 15 to 40% by weight, triglycerols 10 to 35% by weight, tetraglycerols 5 to 20% by weight, pentaglycerols 2 to 10% by weight and the remainder oligoglycerols.

In addition to the component a) and the component b) and water, the compositions according to the invention may also comprise further constituents, and in particular, further emulsifiers, preferably nonionic emulsifiers. Nonionic emulsifiers are characterized by their skin friendliness and mildness and their ecotoxicologically good properties. The use of a combination of nonionic emulsifiers gives particularly finely divided emulsions, meaning that the stability of the composition is increased. The composition according to the invention comprises the coemulsifiers in an amount of from 0% to 15% by weight, preferably from 1% to 10% by weight and in particular from 3% to 10% by weight, based on the total weight of the composition.

Furthermore, the compositions according to the invention may contain further conventional ingredients, for example silicone waxes or polysiloxanes, in amounts of from 1% to 6% by weight, preferably from 1.5% to 5.5% by weight and in particular from 2% to 5% by weight. Polysiloxanes are known polymeric compounds which contain the following structure as monomer units:

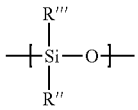

Here, R" and R'", independently of one another, are hydrogen or an alkyl, cycloalkyl, aryl or alkenyl radical. Siloxanes of this type preferably have viscosities at 37° C. in the range from 5 to 5000 mPa s.

In addition, and preferably, the lotion may comprise skin-friendly or skincare substances, in amounts of from 0.1% to 10% by weight, preferably from 1% to 8% by weight most preferably from 2% to 6% by weight. Ingredients of this type may, for example, be bisabolol, alantoin and panthenol. It is also possible to use vitamins, preferably vitamin E and vitamin precursors, and protein hydrolysates. Also suitable are plant extracts, such as from camomile, aloe vera, lime blossom, horse chestnut, green tea, oak bark, stinging nettle, hops, burdock, horsetail, hawthorn, almond, spruce needle, almond wood, juniper, coconut, apricot, lemon, wheat, kiwi, melon, orange, grapefruit, sage, rosemary, birch, mallow, thyme, balm, restharrow, coltsfoot, ginseng and root ginger. In addition, however, other skincare substances may also be present. Those which may be named here are, in particular, chitosan, and zinc oxide or zinc ricinoleate.

In a particular embodiment, the emulsions may comprise further optional additives, such as, for example, superfatting agents, thickeners, polymers, waxes, biogenic active ingredients, deodorant active ingredients, film formers, UV light protection factors, antioxidants, hydrotropic agents, preservatives, insect repellents, self-tanning agents, solubilizers, stabilizers, perfume oils, dyes, antimicrobial agents and the like.

Superfatting agents which can be used are substances such as, for example, lanolin and lecithin, and polyethoxylated or acylated lanolin and lecithin derivatives, polyol fatty acid esters, monoglycerides and fatty acid alkanolamides, the latter also serving as foam stabilizers.

Suitable thickeners are, for example, Aerosil grades (hydrophilic silicas), polysaccharides, in particular xanthan gum, guar guar, agar agar, alginates and Tyloses, carboxymethylcellulose and hydroxyethylcellulose, and also relatively high molecular weight polyethylene glycol mono- and diesters of fatty acids, polyacrylates (e.g. Carbopols® from Goodrich or Synthalens® from Sigma), polyacrylamides, polyvinyl alcohol and polyvinylpyrrolidone, surfactants, such as, for example, ethoxylated fatty acid glycerides, esters of fatty acids with polyols, such as, for example, pentaerythritol or trimethylolpropane, fatty alcohol ethoxylates with a narrowed homologue distribution or alkyl oligoglucosides, and electrolytes such as sodium chloride and ammonium chloride.

Suitable cationic polymers are, for example, cationic cellulose derivatives, such as, for example, a quaternized hydroxyethylcellulose available under the name Polymer JR 400® from Amerchol, cationic starch, copolymers of diallylammonium salts and acrylamides, quaternized vinylpyrrolidone/vinylimidazole polymers, such as, for example, Luviquat® (BASF), condensation products of polyglycols and amines, quaternized collagen polypeptides, such as, for example, lauryldimonium hydroxypropyl hydrolysed collagen (Lamequat®L/Grünau), quaternized wheat polypeptides, polyethyleneimine, cationic silicone polymers, such as, for example, amidomethicones, copolymers of adipic acid and dimethylaminohydroxypropyldiethylenetriamine (Cartaretins®/Sandoz), copolymers of acrylic acid with dimethyldiallylammonium chloride (Merquat® 550/Chemviron), polyaminopolyamides, cationic chitin derivatives, such as, for example, quaternized chitosan, optionally in microcrystalline dispersion, condensation products from dihaloalkyls, such as, for example, dibromobutane with bisdialkylamines, such as, for example, bis-dimethylamino-1,3-propane, cationic guar gum, such as, for example, Jaguar® CBS, Jaguar® C-17, Jaguar® C-16 from Celanese, quaternized ammonium salt polymers, such as, for example, Mirapol® A-15, Mirapol® AD-1, Mirapol® AZ-1 from Miranol.

Suitable anionic, zwitterionic, amphoteric and nonionic polymers are, for example, vinyl acetate/crotonic acid copolymers, vinylpyrrolidone/vinyl acrylate copolymers, vinyl acetate/butyl maleate/isobornyl acrylate copolymers, methyl vinyl ether/maleic anhydride copolymers and esters thereof, uncrosslinked polyacrylic acids, polyacrylic acids crosslinked with polyols, acrylamidopropyltrimethylammonium chloride/acrylate copolymers, octylacrylamide/methyl methacrylate/tert-butylaminoethyl methacrylate/2-hydroxypropyl methacrylate copolymers, polyvinylpyrrolidone, vinylpyrrolidone/vinyl acetate copolymers, vinylpyrrolidone/dimethylaminoethyl methacrylate/vinylcaprolactam terpolymers, and optionally derivatized cellulose ethers and silicones.

Biogenic active ingredients are to be understood as meaning, for example, tocopherol, tocopherol acetate, tocopherol palmitate, ascorbic acid, deoxyribonucleic acid, retinol, bisabolol, allantoin, phytantriol, panthenol, α-hydroxycarboxylic acids, amino acids, ceramides, pseudoceramides, essential oils, plant extracts and vitamin complexes.

Suitable deodorant active ingredients are, for example, antiperspirants, such as, for example, aluminium chlorhydrate, aluminium zirconium chlorhydrates, and zinc salts. These are used for the preparation of antiperspirant and deodorizing preparations and probably act via the partial closure of the sweat glands by protein and/or polysaccharide precipitation. In addition to the chlorhydrates, it is also possible to use aluminiumhydroxylactates and acidic aluminium/zirconium salts. An aluminium chlorhydrate which corresponds to the formula $[Al_2(OH)_5Cl]\cdot 2.5\ H_2O$ and whose use is particularly preferred is commercially available under the tradename Locron® by Clariant GmbH, for example. Likewise preferred according to the invention is the use of aluminium zirconium tetrachlorohydrex glycine complexes, which are marketed, for example, by Reheis under the name Rezal® 36G. Further deodorant active ingredients which may be added are esterase inhibitors. These are preferably trialkyl citrates, such as trimethyl citrate, tripropyl citrate, triisopropyl citrate, tributyl citrate and, in particular, triethyl citrate (Hydagen® C.A.T., Cognis Deutschland GmbH). These substances inhibit the enzyme activity, thus reducing the formation of odour. Presumably, in this process, the cleavage of the citric ester results in the release of the free acid, which lowers the pH on the skin sufficiently for the enzymes to be inhibited. Further substances which are suitable as esterase inhibitors are sterol sulphates or phosphates, such as, for example, the sulphates and phosphates of lanosterol, cholesterol, campesterol, stigmasterol and sitosterol, dicarboxylic acids and esters thereof, such as, for example, glutaric acid, monoethyl glutarate, diethyl glutarate, adipic acid, monoethyl adipate, diethyl adipate, malonic acid and diethyl malonate, hydroxycarboxylic acids and esters thereof, such as, for example, citric acid, malic acid, tartaric acid or diethyl tartrate. Antibacterial active ingredients which influence the bacterial flora and destroy bacteria which decompose perspiration or inhibit them in their growth can likewise be present in the emulsions. Examples thereof are chitosan, phenoxyethanol and chlorhexidine gluconate. 5-Chloro-2-(2,4-dichlorophenoxy)phenol, which is sold under the name Irgasan® by Ciba-Geigy, Basle/CH, have proven particularly effective.

To improve flow behaviour of the composition, it is also possible to use hydrotropic agents, such as, for example, ethanol, isopropyl alcohol, or polyols. Polyols that are suitable here preferably have 2 to 15 carbon atoms and at least two hydroxyl groups. The polyols can also contain further functional groups, in particular amino groups, or be modified with nitrogen. The overall fraction of optional additives may be from 1% to 50% by weight, preferably from 5% to 40% by weight, based on the compositions.

Furthermore, it may be advantageous to co-use optional components to stabilise the emulsion, for example glycerol or magnesium sulphate, preferably in amounts of in each case 0.1 to at most 5% by weight, preferably from 0.1 to 1.5% by weight.

The composition can be prepared by customary cold or hot processes; preference is given to using the phase inversion temperature method.

In the following examples the following composition was used:

84

40% by weight of partial glyceride/triglyceride mixture based on $C_{14}/C_{16}$-fatty acids, melting range: 33.0° C. -35.5° C.

15% by weight of partial glyceride/triglyceride mixture based on $C_{14}/C_{16}$-fatty acids, melting range 40.0° C. -42.0° C.

13% by weight of polyvinyl stearyl ether 1.45% by weight of glycerol (86% pure)

0.30% by weight of $MgSO_4 7\ H_2O$

Remainder: water

58 Reference lotion comprising:

50-60% by weight of a mixture of partial glycerides of coconut fatty acids, melting point 30-34° C.

10-20% by weight of stearyl alcohol, melting point 56-60° C.

20% by weight of polyvinyl stearyl ether, melting point 45-48° C.

2% by weight of silicone wax.

Results from FIGS. 5-10, spray tests when spraying with equipment shown in FIG. 2*a* with two different lotions at different temperatures.

Figure 5:
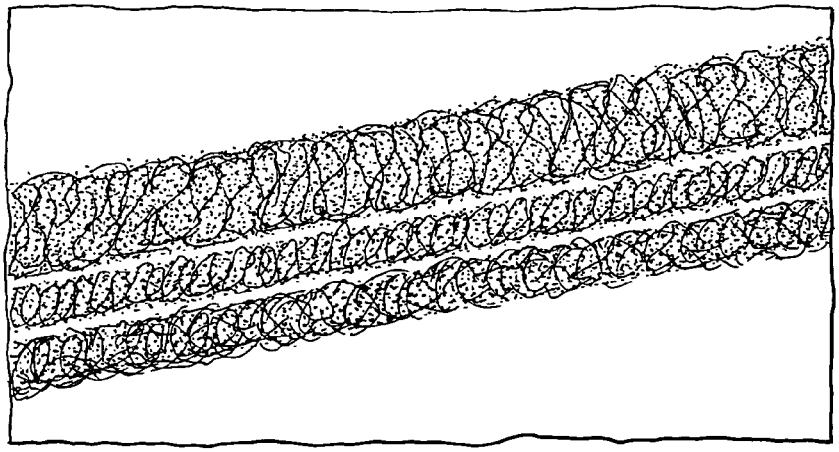
FIGS. 5-10 show different spray patterns.
Figure 6:
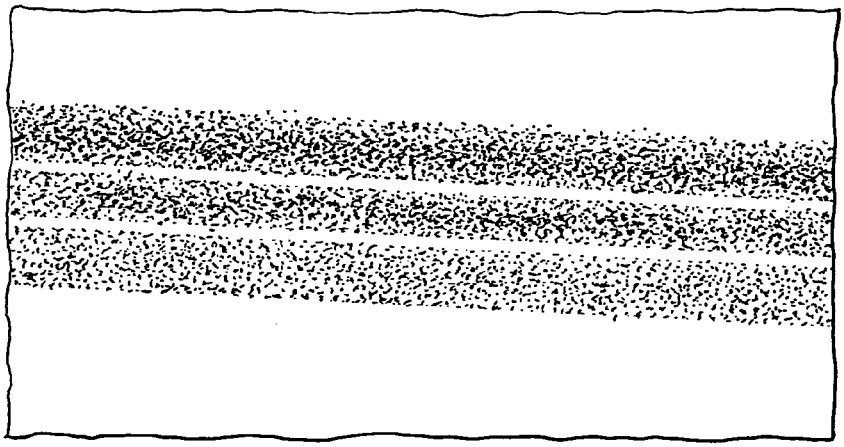
Figure 7:
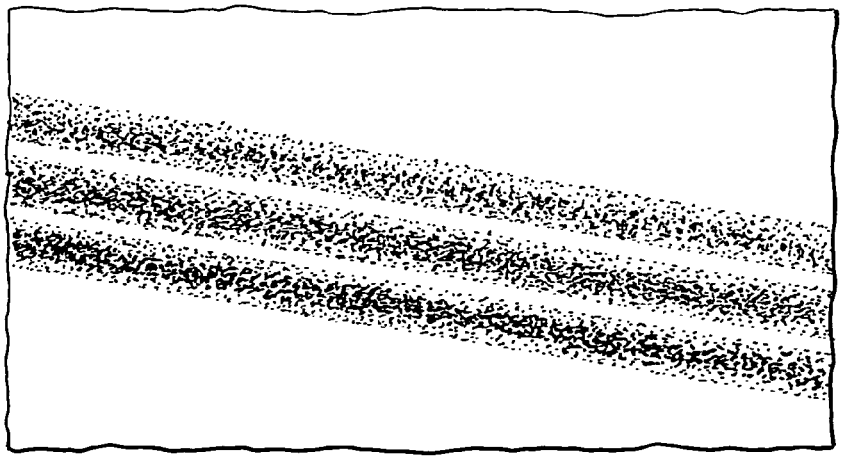
Figure 8:
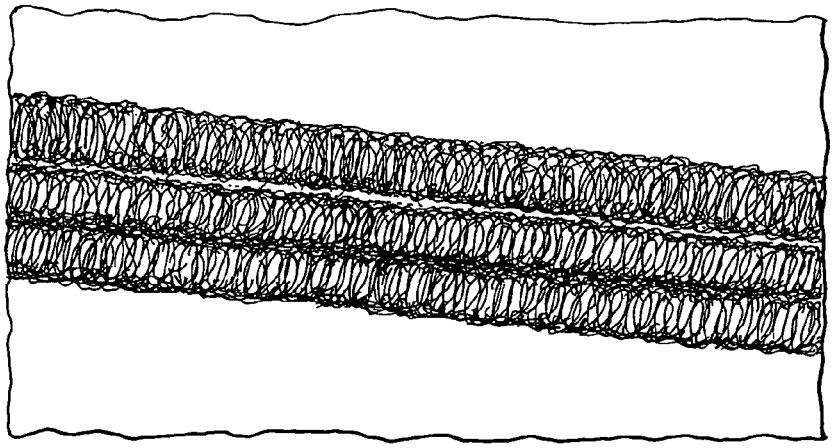
Figure 9:
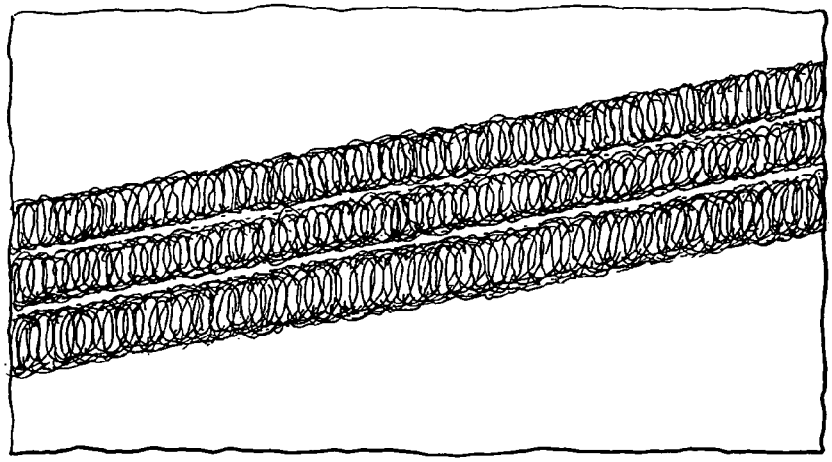
Figure 10:
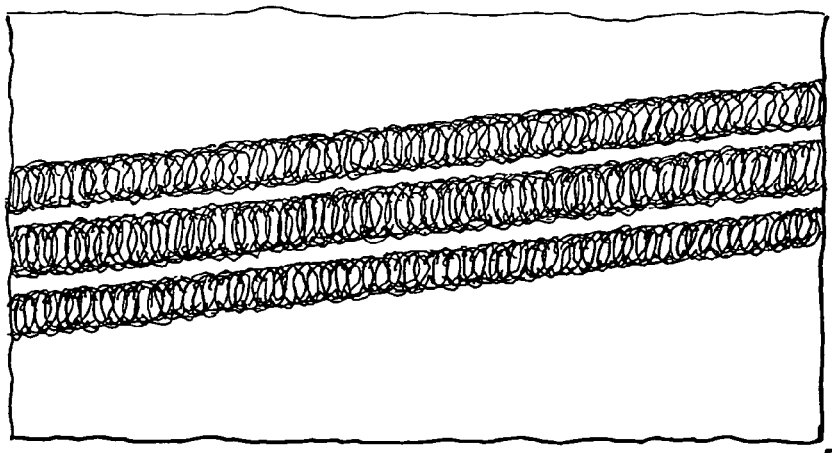

| Sample | container rr (° C.) | tube (° C.) | Nozzle (° C.) | Pattern when spraying |
|---|---|---|---|---|
| 58 (5) | 55 | 55 | 55 | Aerosol/traces of string pattern - FIG. 5 |
| 58 (6) | 60 | 60 | 60 | Aerosol pattern - FIG. 6 |
| 58 (7) | 60 | 65 | 70 | Aerosol pattern - FIG. 7 |
| 84 (8) | 55 | 55 | 55 | Continuous fiberised string |
| 84 (10) | 60 | 60 | 60 | Continuous fiberised string |
| 84 (2) | 65 | 68 | 75 | Continuous fiberised string |

Figure 11:
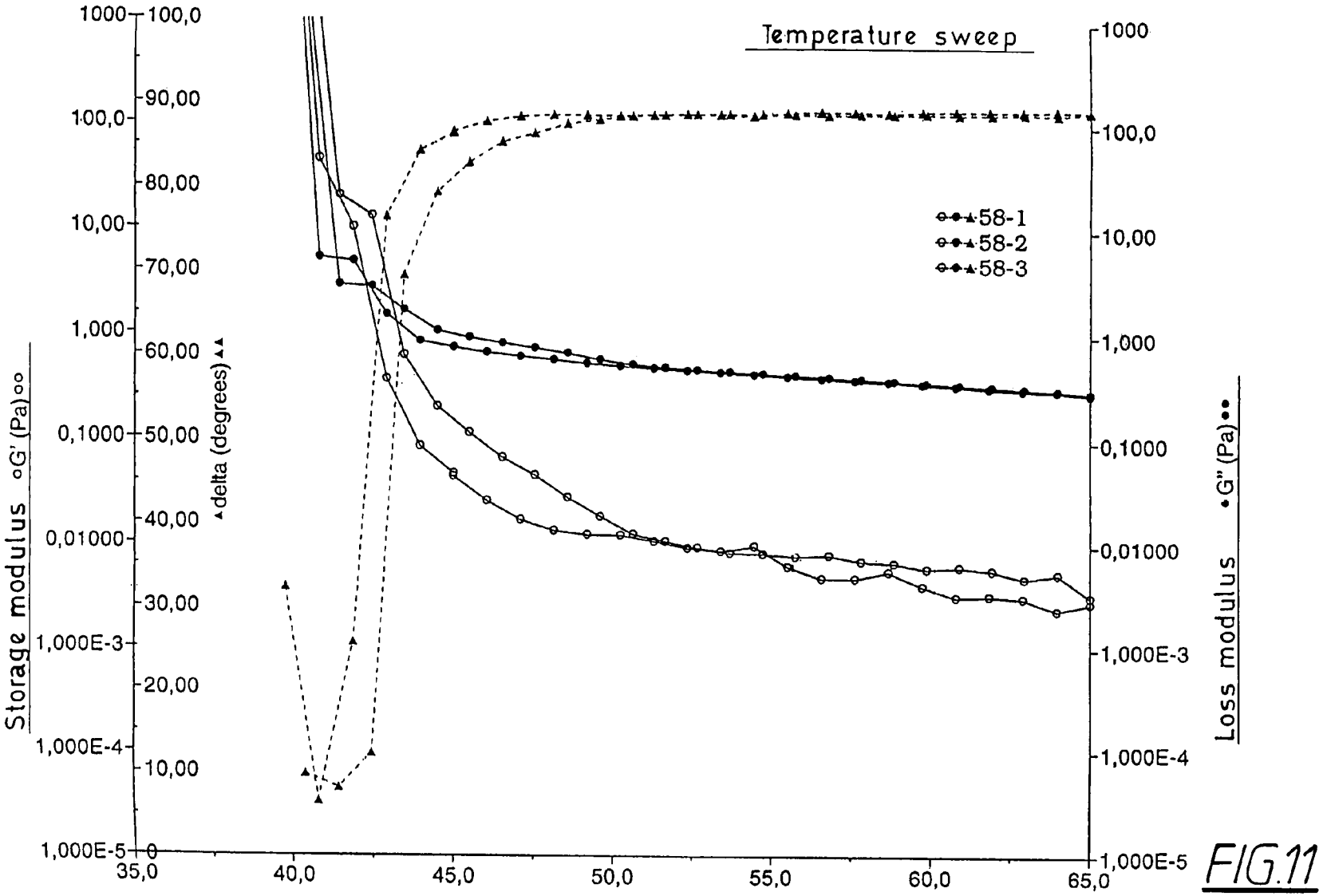
FIGS. 11-12 show temperature sweep graphs.
Figure 12:
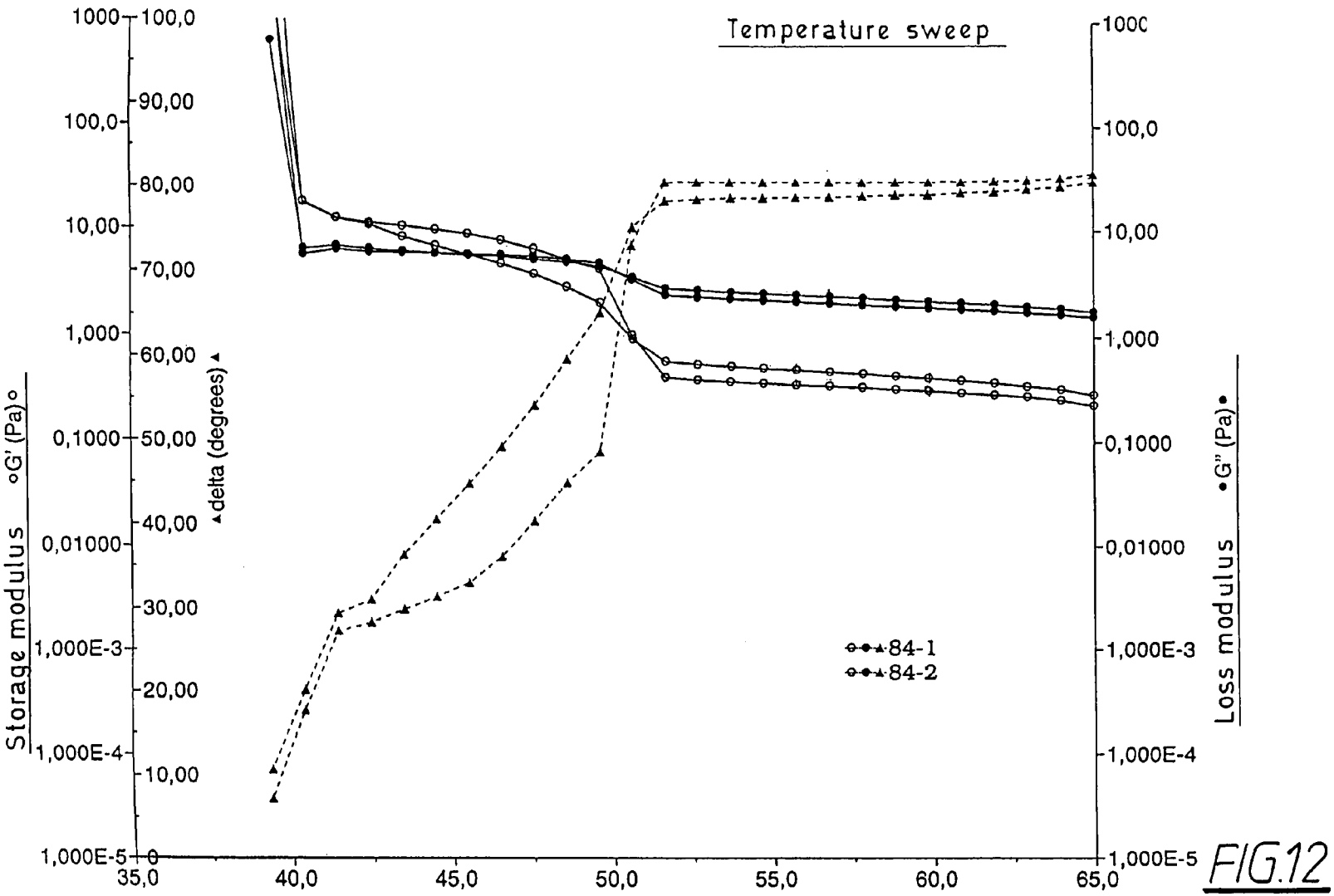

Characteristics at 55° C. (from FIGS. 11-12):

| | Lotion | |
|---|---|---|
| | 58 | 84 |
| Loss modulus | 0.3 Pa | 2.0 Pa |
| Storage modulus | 0.01 Pa | 0.6 Pa |

The measurements were made using a Rheometer AR 1000-N, TA

Instruments, UK:

Temperature sweep:

| | |
|---|---|
| Oscillation procedure | Temperature sweep |
| Material | Acrylic plate ϕ 4 cm |
| Gap | 200 μm |
| Temperature interval | 65-35° C |
| Torque | 10 μNm |
| Frequency | 1 Hz |

Hot melt adhesive equipment (such as described in FIG. 2*a*) parameters when spraying with lotion 58:

| | |
|---|---|
| Module | Nordson, five modules (two blocked) |
| Spray head | 3 Nordson Nr. 755957-ϕ12 (0,012) - 12 air jets-SPC |
| Container | Nordson with pump pr6m1. |
| Temp (sample 5) | Container: 55° C., tube: 55° C., nozzle: 55° C. |
| Temp (sample 6) | Container: 60° C., tube: 60° C., nozzle: 60° C. |
| Temp (sample 7) | Container: 60° C., tube: 65° C., nozzle: 70° C. |
| Speed | 80 m/min |
| Spray air pressure | 0.4 bar |
| Distance spray head/material | 15 mm |

Hot melt adhesive equipment (such as described in FIG. 2*a*) parameters when spraying with lotion 84:

| | |
|---|---|
| Module | Nordson, five modules (two blocked) |
| Spray head | 3 Nordson Nr. 755957-(12 (0,012) - 12 air jets-SPC |
| Container | Nordson with pump pr6m 1. |
| Temp (sample 8) | Container: 55° C., tube: 55° C., nozzle: 55° C. |
| Temp (sample 10) | Container: 60° C., tube: 60° C., nozzle: 60° C. |
| Temp | Container: 65° C., tube: 68° C., nozzle: 75° C. |
| Speed | 80 m/min |
| Spray air pressure | 0.4 bar |
| Distance spray head/material | 15 mm |

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims be embraced thereby.

We claim:

1. A method for applying lotion to a surface of an absorbent article, said method comprising the steps of:

placing the surface of the absorbent article in the proximity of a spraying apparatus comprising a spray head having an orifice, providing a lotion exhibiting a storage modulus of at least 0.2 Pa measured at 55° C., and pushing the lotion through the spray head orifice, wherein the lotion is propelled to the surface as a continuous fiberised string without the formation of a lotion aerosol.

2. The method according to claim 1, wherein the surface of the absorbent article is placed at a distance of from 15 to 300 mm from the spray head.

3. The method according to claim 1, wherein the lotion is propelled from the orifice by an air stream which is separated from the orifice.

4. The method according to claim 1, wherein the lotion is delivered with a velocity of at least 80 m/min.

5. The method according to claim 1, wherein the lotion is propelled to the surface as a spiral-shaped continuous fiberised string.

6. The method according to claim 1, wherein the fiberised string has a diameter of less than 2.2 mm.

7. An absorbent article comprising a substantially liquid impermeable back sheet, a substantially liquid permeable topsheet and an absorbent core placed between the back sheet and the topsheet, wherein a surface of the absorbent article is provided with lotion which has been applied with the method according to claim 1.

8. The method according to claim 1, wherein the lotion exhibits a storage modulus of at least 0.6 Pa measured at 55° C.

9. The method according to claim 1, wherein the lotion exhibits a loss modulus of at least 2.0 Pa measured at 55° C.

10. The absorbent article according to claim 7, wherein the lotion composition includes:

a) 5% to 50% by weight of a component melting in the range from 25° C. to 37° C., selected from the group consisting of paraffins, fatty acid esters, polyhydroxy fatty acid esters, fatty alcohols, alkoxylated fatty acid esters, alkoxylated fatty alcohols and mixtures of these compounds; and b) 5% to 50% by weight of a component melting in the range from 40 to 60° C., selected from the group consisting of polyhydroxy fatty acid esters, $C_{14}$-$C_{22}$-fatty alcohols, $C_{12}$-$C_{22}$-fatty acids, the alkoxylated derivatives of the fatty alcohols and fatty esters, and mixtures of these components; and c) 25% to 45% by weight of water.

11. The absorbent article according to claim 7, wherein the lotion is placed on the topsheet in a continuous fiberised string.

12. The absorbent article according to claim 7, wherein the diameter of the fiberised string is less than 2.2 mm.

13. The absorbent article according to claim 7, wherein the absorbent article is selected from the group consisting of pant diapers, diapers, incontinence devices, sanitary napkins, pantiliners and micro-sanitary napkins.

14. A method for applying lotion to a surface of an absorbent article, said method comprising the steps of:

placing the surface of the absorbent article in the proximity of a spraying apparatus comprising a spray head having an orifice, providing a lotion exhibiting a storage modulus of at least 0.2 Pa measured at 55° C., and pushing the lotion through the spray head orifice, wherein the lotion is propelled to the surface as a continuous fiberised string and the lotion composition includes:

a) 5% to 50% by weight of a component melting in the range from 25° C. to 37° C., selected from the group consisting of paraffins, fatty acid esters, polyhydroxy fatty acid esters, fatty alcohols, alkoxylated fatty acid esters, alkoxylated fatty alcohols and mixtures of these compounds; and b) 5% to 50% by weight of a component melting in the range from 40 to 60° C., selected from the group consisting of polyhydroxy fatty acid esters, $C_{14}$-$C_{22}$-fatty alcohols, $C_{12}$-$C_{22}$-fatty acids, the alkoxylated derivatives of the fatty alcohols and fatty esters, and mixtures of these components; and c) 25% to 45% by weight of water.

15. The method according to claim 14, wherein the diameter of the fiberised string is less than 2.2 mm.

* * * * *